United States Patent [19]

Vander et al.

[11] 4,231,845

[45] Nov. 4, 1980

[54] EQUIPMENT FOR EMISSION-FREE OPERATION OF A COKING PLANT

[75] Inventors: Timen Vander, Ursem; Nicolaas J. Thijssen, Santpoort; Jan F. de Blok, Beverwijk; Jan Middel, Nieuwe Sluis, all of Netherlands

[73] Assignee: Hoogovens Ijmuiden, B.V., IJmuiden, Netherlands

[21] Appl. No.: 49,115

[22] Filed: Jun. 18, 1979

Related U.S. Application Data

[62] Division of Ser. No. 870,138, Jan. 17, 1978, abandoned.

[30] Foreign Application Priority Data

Jan. 24, 1977 [NL] Netherlands ..... 7700675

[51] Int. Cl.[2] ..... C10B 27/00; C10B 27/04; C10B 41/06; C10B 41/08

[52] U.S. Cl. ..... 202/113; 202/255; 202/263; 202/270; 201/1; 201/35; 201/41

[58] Field of Search ..... 201/1, 35, 41; 202/254–256, 262, 263, 270, 113

[56] References Cited

U.S. PATENT DOCUMENTS

| | | | |
|---|---|---|---|
| 2,975,109 | 3/1961 | Van Ackeren | 202/255 |
| 3,647,053 | 3/1972 | Palumbo | 201/1 |
| 4,105,503 | 8/1978 | Bruce | 202/255 |

FOREIGN PATENT DOCUMENTS

| | | | |
|---|---|---|---|
| 2416524 | 11/1974 | Fed. Rep. of Germany | 202/263 |
| 1460735 | 1/1977 | United Kingdom . | |

*Primary Examiner*—Bradley R. Garris

*Attorney, Agent, or Firm*—Stevens, Davis, Miller & Mosher

[57] ABSTRACT

Injection of steam into the ascension pipe of each coking chamber in a coking plant is continued for a period of time after charging of that chamber so as to create a slightly sub-atmospheric pressure in the chamber during the initial stage of the coking process, in order to reduce leakage of gas and fumes to the atmosphere past the doors and filling openings. A time clock operated by the coke pusher machine or by the coal charging machine stops this injection of steam after a desired period of time.

2 Claims, 2 Drawing Figures

EQUIPMENT FOR EMISSION-FREE OPERATION OF A COKING PLANT

This is a division of application Ser. No. 870,138 filed Jan. 17, 1978, and now abandoned.

BACKGROUND OF THE INVENTION

1. Field of the Invention

The invention relates to a method of operation of a coking plant having coke chambers for the coking of coal by dry distillation, and to a coking plant adapted for operation by the method of the invention. The invention is particularly concerned with the reduction or prevention of the emission to the atmosphere of undesirable gas and dust, etc.

2. Description of the Prior Art

In the manufacture of coke, continuous efforts have been made to prevent as far as possible emission of smoke, soot and dust into the atmosphere while the coke chambers are being charged with coal. A number of proposals to this end are described in British patent specification 1,291,096, particularly that the steam is supplied to the steam injector in the ascension pipe of the chamber concerned while it is being charged through the charging holes in the roof. In the ascension pipe a sub-atmospheric pressure of 2 to 6 mm water column is thus created during charging. After levelling and closing of the charging holes, the steam supply to the injectors in the ascension pipe is cut off, and coking is initiated.

Notwithstanding all the precautions taken, such as systematic cleaning of the door posts, and the doors themselves, it has proved not to be feasible to seal the two doors at the ends of each of the horizontal oven chambers sufficiently. In the initial phase of the coking process, considerable gas formation occurs in the oven chambers, together with a slight super-atmospheric pressure. This overpressure—depending on the pressure set in the gas collecting main—drops within 5 hours from about 10 to 0 mm water column, measured at the bottom of the chamber door, while by the end of the coking time a sub-atmospheric pressure of about −1 mm prevails. (See also W. Litterscheidt's contribution to the "Handbuch des Kokereiwesens", published by Dr. Otto Grosskinsky, Vol. I, 1955 Dusseldorf, page 217—where it is mentioned that the level of maximum pressure and the variation of pressure, in the chamber depend on the type of coal and on the degasification conditions). In the initial stage of the coking process there is consequently an over-pressure, which escapes through unintentional leakage past doors etc., and is perceived as disagreeable smoke and fumes. Even if steam injection is applied during charging as described above, the undesirable emission continues.

SUMMARY OF THE INVENTION

The object of this invention is therefore to prevent this objectionable emission during the initial stages of coking.

Another object of the invention is to provide suitable control means for effecting prevention or control of this emission.

For this purpose, according to the method of the invention, a sub-atmospheric pressure, e.g. of a few mm water column is additionally maintained in the chamber during the initial phase of the coking process by steam injection into the gas vent pipe.

Preferably according to the invention the sub-atmospheric pressure is maintained for a predetermined period of time during said initial phase which period of time begins after levelling of the coal charged into the chamber. This period of time should preferably be between 15 and 45 minutes, and more preferably is about 30 minutes.

The degree of sub-atmospheric pressure which is maintained in the initial stage of the coking process by steam injection into the gas vent pipe i.e. the difference between this pressure and atmospheric pressure may be gradually reduced as the said period of time elapses.

The invention also relates to a coking plant having a plurality of coking chambers for the coking of coal by dry distillation, wherein each chamber has an ascension pipe for the discharge of the gases evolved during coking and means are provided for injecting steam into the ascension pipe so as to create a sub-atmospheric pressure in the chamber. According to the invention in such a coking plant the said injecting means is controlled by a time clock which, after a chamber has been charged with coal, stops the injection of steam to the ascension pipe of that chamber when a period of time has elapsed following the commencement of the coking process in the chamber.

Preferably the time clock is adjustable to vary the period of time before the injection of steam is stopped.

The measurement by the time clock of a predetermined period after which the injection of steam is stopped, can be initiated by any suitably derived signal. Preferably the signal is given to the clock by one of the machines which travel along the row of coking chambers. For instance, the beginning of the predetermined period may be determined by the step of levelling the coal charged into the chamber, in which case the time clock may be actuated pneumatically to initiate the predetermined period by means of a pulse of air delivered by the coke pusher machine which also carries the coal leveller bar.

A signal to cause the start of injection of steam into the ascension pipe of a given chamber may be provided by the coal charging machine or the coke pusher machine upon commencement of charging of that chamber. The coal charging machine may also give the signal to cause the time clock to start measurement of the predetermined time period, for instance at the time closing of the charging hole or holes, instead of this signal being given by the coke pusher machine.

It may be mentioned that U.K. Pat. No. 1,460,735 describes a process for treatment of the dust arising during and after charging of a coking chamber. During charging, and for a selected period thereafter, the dust-laden gases passing up the ascension pipe are first cooled and then passed to a series of combustion chambers. There is no suggestion here that a sub-atmospheric pressure be created in the chamber during this time.

BRIEF DESCRIPTION OF THE DRAWINGS

The preferred embodiment of the invention will now be described by way of non-limitative example with reference to the accompanying drawings, in which.

DESCRIPTION OF THE PREFERRED EMBODIMENT

Figure 1:
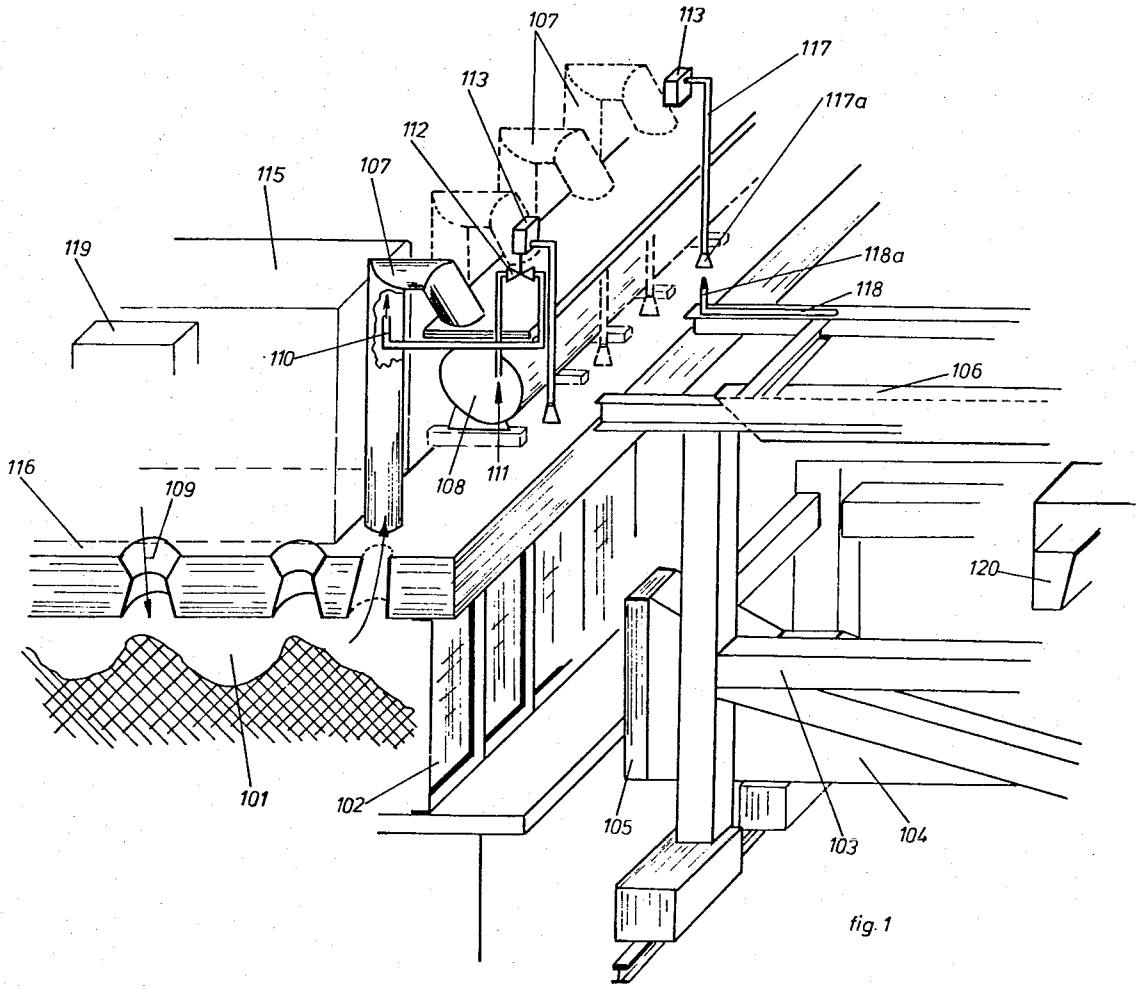
FIG. 1 shows diagrammatically and in perspective, partly in elevation and partly in cross-section, the arrangement on the so-called machine side or pusher side of a coking plant where the invention has been applied.
Figure 2:
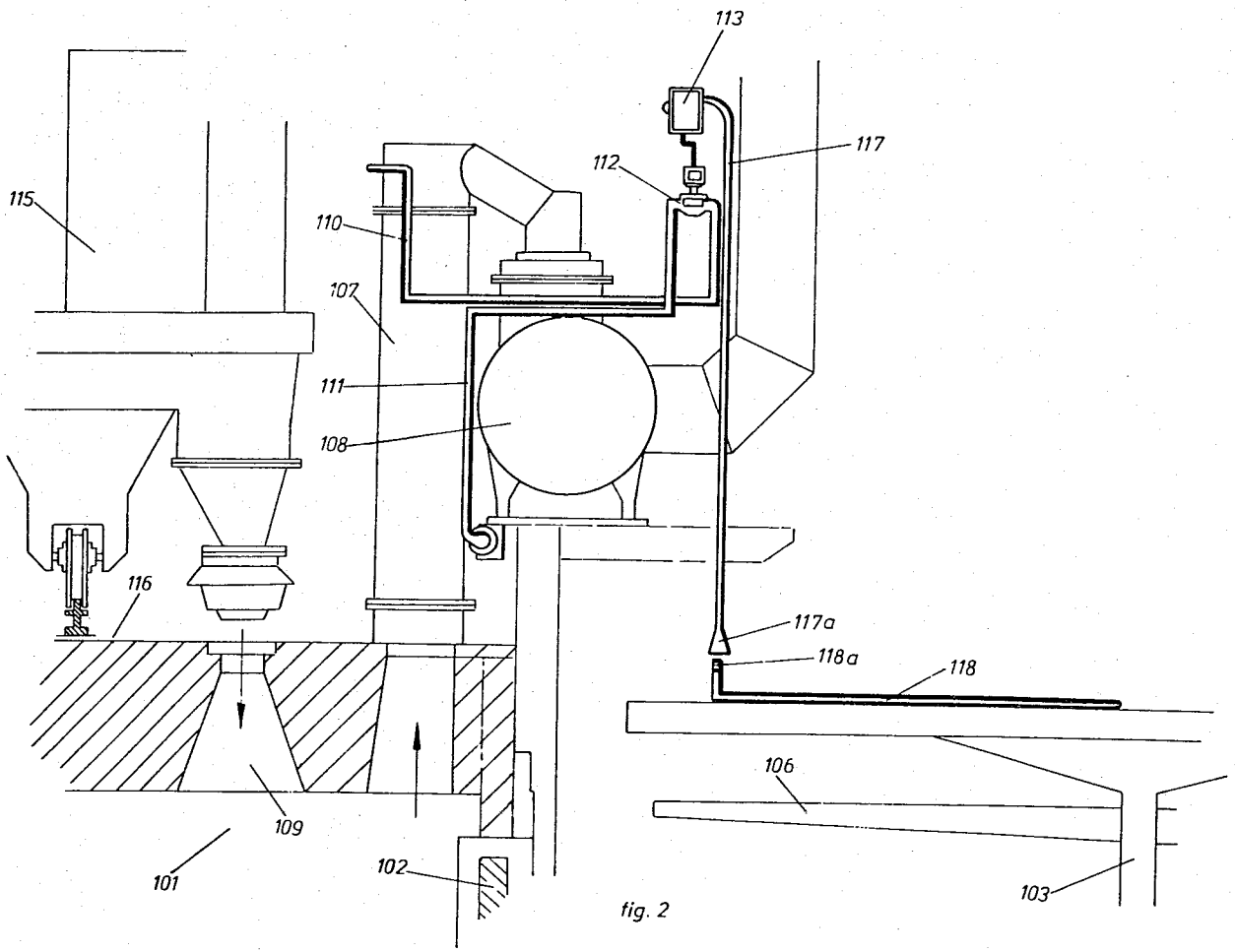
FIG. 2 shows, partly in cross-section and partly in elevation, the arrangement on the machine side of the coking plant illustrated in FIG. 1 in more detail.

In both Figures, the machine side of a coking plant is shown, one of the coking chambers being indicated by 101. FIG. 1 shows schematically that this coking chamber 101 has just been charged nearly to capacity with coking coal. The coal has not yet been levelled. The horizontal coke chamber 101 is closed on both sides by doors, the door on the machine side being indicated by 102. After coking, the doors of the coke chamber in question are removed on both sides and the mobile coke pusher machine 103 is put into operation in order to push the coked coke through the chamber 101 into the waiting mobile coke quenching car.

The coke pusher machine 103 is movable on rails along the row of coke chambers and is equipped with a pusher mechanism 104 and a ram 105 for pushing out the coked coke.

Immediately after pushing out the coke and cleaning of the door posts, the doors of the empty coke chamber are closed and re-charging of the coke chamber with coking coal begins. This takes place by means of a charging car 115, which can be moved along rails on the deck 116 of the plant. By means of telescopic charging hoppers the coking coal is removed from the charging car and dumped into the coke chamber through the charging holes 109. As soon as charging has come to an end the charging holes 109 are closed.

During the coking process, the gases released by the distillation of the coal are removed via the ascension pipe 107 which debouches into a gas-collecting main 108. A steam injection 110 is provided in the ascension pipe. This injector is connected to a steam supply conduit 111 via a steam valve 112. The operating mechanism of steam valve 112 is controlled by a time clock 113. In the embodiment shown, this is a pneumatically actuated time clock. A fairly wide air conduit 117 runs from the time clock 113 downwards and ends in a downwardly open funnel 117A. The mobile coke pusher machine 103 is provided with an air delivery conduit 118 which debouches at a nozzle 118A.

From the control cabin 120 of the coke pusher machine 103, a leveller bar 106 is set in motion when the coke chamber 101 has been charged. This bar levels the top surface of the coal through the opened levelling hatch 114 in the door 102. In the embodiment shown, this leveller bar 106 is connected to an air valve, by means of which a short pulse of air can be conveyed to the clock 113 through the conduit 118, the nozzle 118A, the funnel 117A and the conduit 117. This action causes the time clock 113 to start to measure a predetermined period of time during which steam originating from the steam conduit 111 is conveyed through the valve 112 to the injector 110 in the relevant ascension pipe 107. Because of this steam injection, a slight sub-atmospheric pressure e.g. a few mm water pressure below atmospheric, is created in the coke chamber 101, this pressure being sufficient to prevent or reduce gas and smoke from escaping via possible leaks, for instance past the doors. The flow of steam has been started earlier, e.g. as described below, in order that there shall be a reduced pressure in the chamber during charging.

Whilst British Pat. No. 1,291,096 states that the steam is shut off as soon as a coke chamber has been completely charged, the time clock 113 provided in accordance with the invention on the other hand allows this steam injection to continue for some time. After starting the clock 113, the coke pusher machine 103 can travel away to another location. The time clock 113 which in the embodiment given is pneumatically actuated, recloses the steam valve 112 after an adjustable predetermined period of time of about 15 to 45 minutes has passed. On average, this time may amount to 30 minutes. Because of this sub-atmospheric pressure in the coke chamber 101, escape of gas and smoke past the doors etc. is prevented or much reduced.

As a matter of convenience—since it is simple to achieve operation of the air valve for the conduit 118 by the leveller bar 106—the adjustable time period measured by the clock 113 is reckoned after levelling of the coal charged into the chamber. Of course it is possible to equip the charging car instead of the coke pusher machine with means for actuating the clock 113, but in such a case a different instant will have to be chosen as the starting time for the clock, for instance when the covers of the charging holes 109 are being replaced.

The operator, who is either in the control cabin 112 on the charging car or in the control cabin 102 on the coke pusher machine can in either arrangement give the command for the commencement of the steam supply to the ascension pipe. This command is given at the beginning of charging, so that the sub-atmospheric pressure is created during charging. Subsequently in both embodiments the charging car or the coke pusher machine can travel away after charging and a sub-atmospheric pressure prevails in the coke chamber during an initial period of the coking process. The end of this period is controlled by the time clock.

Besides the known advantages associated with the known expedient of extraction of the gases arising during filling, the additional advantage is now achieved that the charging car (if the steam injector is operated from the charging car) need not wait for completion of levelling, so that it can move on to be used elsewhere before the levelling hatch is closed again. In this way the charging car can be put to use far more efficiently.

Since even after closing of the charging covers, the chamber is kept at a sub-atmospheric pressure for e.g. about half an hour after charging, the quantity of leaking gas escaping through the covers of the charging holes or the doors into the open air is notably smaller. This contributes substantially towards emission-free operation of a coking plant, and results in an improvement of the working conditions for employees working on or near the oven deck, while at the same time improving the environment.

Another advantage is that the quantity of dust escaping through possible cracks in the walls of the coke chamber into the combustion chambers, to leave a chimney as black smoke, can be considerably reduced. This also contributes to a better environment.

Another advantage of steam injection according to this invention is that the ascension pipe is cleared of tar deposits and in addition the gas flow is assisted.

As already mentioned, there is normally a slight overpressure created in the coke chamber during the first five hours of the coking process. However, it may not be desirable to maintain the sub-atmospheric pressure in the coke chamber for the same length of time by injecting steam into the ascension pipe, since this would cause intake of air into the coke chamber which is harmful because the resultant ash is aggressive to the refractory masonry. However, the degree of sub-atmospheric pressure maintained during the initial phase of the coking process by steam injection into the gas vent pipe can be reduced gradually during the initial phase.

We claim

1. Coking plant comprising a plurality of coking chambers for the coking of coal by dry distillation, a mobile coke pusher machine for removing coke, a coal leveller bar carried thereby, an ascension pipe for each chamber for the discharge from the chamber of the gases evolved during coking, means for injecting steam into the ascension pipe so as to create a sub-atmospheric pressure in the chamber and adjustable pneumatically actuated timing means after the chamber has been charged with coal stopping the injection of steam to the ascension pipe of that chamber when a period of time has elapsed following the commencement of the coking process in the chamber, determined by the step of levelling of the coal charged into the chamber, said timing means being provided with an air conduit which is connected to the timing means and which ends in a downwardly open funnel, said coke pusher machine bearing an upwardly extending air conduit nozzle, adapted to register with said funnel, to deliver an air pulse, transmitted by the air conduit to actuate the timing means.

2. The coking plant according to claim 1 including a coal charging machine capable of sending a signal upon the commencement of charging coal into the said chamber, said timing means being arranged to cause said injecting means to begin injection of steam into the ascension pipe of a given chamber upon receipt of said signal.

* * * * *